US009957915B2

(12) United States Patent
Kodama

(10) Patent No.: US 9,957,915 B2
(45) Date of Patent: May 1, 2018

(54) CYLINDER HEAD

(71) Applicant: TOYOTA JIDOSHA KABUSHIKI KAISHA, Toyota-shi, Aichi-ken (JP)

(72) Inventor: Kohei Kodama, Numazu (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 20 days.

(21) Appl. No.: 15/151,861

(22) Filed: May 11, 2016

(65) Prior Publication Data

US 2016/0333820 A1 Nov. 17, 2016

(30) Foreign Application Priority Data

May 15, 2015 (JP) ..... 2015-100285

(51) Int. Cl.

| | |
|---|---|
| ***F02M 25/06*** | (2016.01) |
| ***F02F 1/40*** | (2006.01) |
| ***F02M 35/10*** | (2006.01) |
| *F01P 3/02* | (2006.01) |
| *F02M 26/17* | (2016.01) |

(52) U.S. Cl.

CPC ..... *F02F 1/40* (2013.01); *F02M 35/10222* (2013.01); *F01P 2003/027* (2013.01); *F02M 25/06* (2013.01); *F02M 26/17* (2016.02); *F02M 35/10072* (2013.01)

(58) Field of Classification Search

CPC ..... F02F 1/40; F02M 35/10222; F02M 26/17; F02M 35/10072; F02M 25/06; F01P 2003/027

See application file for complete search history.

(56) References Cited

U.S. PATENT DOCUMENTS

| | | | | |
|---|---|---|---|---|
| 4,693,226 A * | 9/1987 | Choma | F02M 35/10085 | 123/568.17 |
| 5,307,784 A * | 5/1994 | Choma | F02M 26/50 | 123/568.17 |
| 2002/0170510 A1* | 11/2002 | Iizuka | F01P 7/16 | 123/41.84 |
| 2004/0103876 A1* | 6/2004 | Spiegel | F01L 1/32 | 123/305 |
| 2016/0265487 A1* | 9/2016 | Beyer | F02M 35/104 | |

FOREIGN PATENT DOCUMENTS

| | | |
|---|---|---|
| CN | 1513081 A | 7/2004 |
| JP | 2004-521229 A | 7/2004 |
| JP | 2006-046139 A | 2/2006 |
| JP | 2013-133746 A | 7/2013 |
| WO | 02/081873 A1 | 10/2002 |

* cited by examiner

*Primary Examiner* — Joseph Dallo
*Assistant Examiner* — Kurt Liethen
(74) *Attorney, Agent, or Firm* — Andrews Kurth Kenyon LLP

(57) ABSTRACT

The cylinder head includes: an intake port; a low-temperature cooling water channel for circulating low-temperature cooling water; a high-temperature cooling water channel for circulating cooling water of a higher temperature than the cooling water flowing through the low-temperature cooling water channel; and a gas channel for recirculating a portion of blow-by gas or EGR gas to the intake port. The low-temperature cooling water channel is configured to include a first water jacket that covers at least one portion of the wall surface of the intake port on an intake-air upstream side relative to an opening end opening at a wall surface of the intake port from the gas channel.

3 Claims, 6 Drawing Sheets

CYLINDER HEAD

CROSS-REFERENCE TO RELATED APPLICATION

The present application claims priority to Japanese Patent Application No. 2015-100285 filed on May 15, 2015, which is incorporated herein by reference in its entirety.

TECHNICAL FIELD

The present invention relates to a cylinder head of an internal combustion engine, and more particularly to a cylinder head that includes a channel through which cooling water flows.

BACKGROUND

A channel through which cooling water flows is formed in a cylinder head of an internal combustion engine. Japanese Patent Laid-Open No. 2013-133746 discloses a configuration in which, in order to cool air inside an intake port, a first cooling water circuit through which cooling water that cools the periphery of an intake port circulates is provided inside a cylinder head independently from a second cooling water circuit through which cooling water that cools the periphery of an exhaust port circulates that is provided inside a cylinder block and the cylinder head.

The first cooling water circuit includes an intake-port cooling water passage that is formed in the cylinder head. The intake-port cooling water passage is connected to a cooling water introduction portion that is provided in an end face in a width direction of the cylinder head. The intake-port cooling water passage widens on the lower side of an intake port from the cooling water introduction portion, and extends to the upper side of the intake port through a side face of the intake port, and is connected to a cooling water lead-out portion that is provided in an end face in a longitudinal direction of the cylinder head through the upper side of the intake port.

SUMMARY

Some internal combustion engines are equipped with an EGR (exhaust gas recirculation) apparatus that recirculates a part of exhaust gas to an intake passage as EGR gas, and a blow-by gas recirculation apparatus that adopts a PCV (positive crankcase ventilation valve) system that recirculates blow-by gas that is inside a crankcase to the intake passage. Exhaust gas or blow-by gas that is recirculated to the intake passage by the EGR apparatus or blow-by gas recirculation apparatus is drawn into a combustion chamber through an intake port.

Oil or fuel components such as unburned gas are contained in EGR gas or blow-by gas. Consequently, when an EGR apparatus or a blow-by gas recirculation apparatus is applied to the internal combustion engine disclosed in Japanese Patent Laid-Open No. 2013-133746, there is a risk that the recirculated EGR gas or blow-by gas will be cooled when passing through the intake port and will condense. If condensed water containing fuel collides against an intake valve or the like that is at a high temperature and is baked and hardened before the condensed water has been drawn into a combustion chamber, the condensed water that is baked and hardened forms a deposit, and such deposits gradually build up.

Thus, in an internal combustion engine in which an intake port is cooled by cooling water of a low temperature, if an EGR apparatus or a blow-by gas recirculation apparatus is provided, there is a risk that a deterioration in the fuel consumption or a malfunction in a valve system function will be caused by a buildup of deposits at an intake valve.

The present invention has been made to solve the above described problem, and an object of the present invention is to provide a cylinder head that can suppress a buildup of deposits that are caused by EGR gas or blow-by gas that is recirculated to an intake port.

In accomplishing the above object, according to a first aspect of the present invention, there is provided a cylinder head for an internal combustion engine including two cooling water circulation systems in which temperatures of cooling water are different, comprising:

an intake port;

a low-temperature cooling water channel for circulating cooling water of a low temperature;

a high-temperature cooling water channel for circulating cooling water of a higher temperature than cooling water flowing through the low-temperature cooling water channel;

a gas channel for recirculating a portion of blow-by gas or EGR gas to the intake port; and an opening end opening at a wall surface of the intake port from the gas channel;

wherein the low-temperature cooling water channel is configured to include a first water jacket covering at least one portion of the wall surface of the intake port, the at least one portion being located on an intake-air upstream side relative to the opening end.

According to a second aspect of the present invention, there is provided the cylinder head according to the first aspect, further comprising:

a port injector provided in the intake port, wherein the opening end is provided on an intake-air upstream side relative to a spray region of fuel from the port injector.

According to a third aspect of the present invention, there is provided the cylinder head according to the first aspect, wherein the first water jacket is provided so as to cover only a portion of the wall surface of the intake port, the portion being located on an intake-air upstream side relative to the opening end.

According to a fourth aspect of the present invention, there is provided the cylinder head according to the first aspect, wherein:

the low-temperature cooling water channel is configured to include a second water jacket covering at least one portion of the wall surface of the intake port, the at least one portion being located on an intake-air downstream side relative to the opening end; and a straightening vane is provided inside the intake port to prevent gas introduced from the opening end into the intake port from contacting the wall surface covered by the second water jacket.

According to a fifth aspect of the present invention, there is provided the cylinder head according to the fourth aspect, wherein:

the second water jacket is configured so as to cover a wall surface on a side facing the opening end; and the straightening vane is provided from the opening end to the wall surface covered by the second water jacket, so as to separate the intake port into a side of the wall surface covered by the second water jacket and a side of the opening end.

In accomplishing the above object, according to an sixth aspect of the present invention, there is provided a cylinder head for an internal combustion engine including two cooling water circulation systems in which temperatures of cooling water are different, comprising:

an intake port;

a low-temperature cooling water channel for circulating cooling water of a low temperature;

a high-temperature cooling water channel for circulating cooling water of a higher temperature than cooling water flowing through the low-temperature cooling water channel;

a gas channel for recirculating a portion of blow-by gas or EGR gas to the intake port; and an opening end opening at a wall surface of the intake port from the gas channel;

wherein:

the low-temperature cooling water channel includes a water jacket that covers at least one portion of the wall surface of the intake port, and a straightening vane is provided inside the intake port to prevent gas introduced into the intake port from the opening end from contacting the wall surface covered by the water jacket.

According to the first aspect of the present invention, a gas channel for recirculating blow-by gas or EGR gas opens into an intake port at a position that is partway along the intake port. Further, a low-temperature cooling water channel is configured to include a first water jacket that covers at least one portion of a wall surface of the intake port that is a portion on an intake-air upstream side relative to an opening end of the gas channel into the intake port. According to this configuration, since flowing of blow-by gas or EGR gas that is recirculated from the gas channel into the intake port along the wall surface that is covered by the first water jacket on the intake-air upstream side relative to an opening end can be decreased, cooling of the blow-by gas or EGR gas by the low-temperature cooling water can be suppressed. By this means, since condensing of blow-by gas or EGR gas can be suppressed, it is possible to suppress a buildup of deposits that are caused by condensed water that contains fuel.

According to the second aspect of the present invention, an opening end of a gas channel for recirculating blow-by gas or EGR gas is provided on an intake-air upstream side relative to a spray region of a port injector. By this means, it is possible to prevent fuel that is sprayed from the port injector from flowing into the gas channel from the opening end, and thus the occurrence of blockages in the gas channel can be suppressed.

According to the third aspect of the present invention, the first water jacket is configured so as to cover only a portion located on the intake-air upstream side relative to the opening end of the gas channel. Consequently, according to the present invention, the occurrence of a situation in which blow-by gas or EGR gas that flows into the intake port from the opening end of the gas channel is cooled by cooling water of a low temperature and condenses can be more reliably suppressed.

According to the fourth aspect of the present invention, the low-temperature cooling water channel includes a second water jacket that covers at least one portion of the wall surface of the intake port on a downstream side relative to the opening end of the gas channel. Further, a straightening vane is provided inside the intake port to prevent gas that is introduced from the opening end into the intake port from contacting a portion of the wall surface that is covered by the second water jacket. Therefore, according to the present invention, even in a case where the second water jacket is positioned on the downstream side of the intake air relative to the opening end, the occurrence of a situation in which blow-by gas or EGR gas contacts a portion of the wall surface that is covered by the second water jacket and is cooled can be suppressed.

According to the fifth aspect of the present invention, the second water jacket is provided so as to cover on a side facing the opening end. The straightening vane is provided in a region from the opening end to the wall surface that is covered by the second water jacket so that the straightening vane isolates the opening end and the wall surface covered by the second water jacket from each other. Consequently, according to the present invention, contact of blow-by gas or EGR gas against a portion of the wall surface that is covered by the second water jacket can be effectively suppressed.

According to the sixth aspect of the present invention, the low-temperature cooling water channel includes a water jacket that covers the wall surface of the intake port. Further, a straightening vane is provided inside the intake port to prevent gas that is introduced into the intake port from the opening end from contacting a wall surface that is covered by the water jacket. Therefore, according to the present invention, even in a case where the water jacket is positioned on a downstream side of the intake air relative to the opening end, the occurrence of a situation in which blow-by gas or EGR gas contacts a wall surface that is covered by the water jacket and is cooled can be suppressed. By this means, since condensing of blow-by gas or EGR gas can be suppressed, it is possible to suppress a buildup of deposits that are caused by condensed water that contains fuel.

DETAILED DESCRIPTION

Embodiments of the present invention are described hereunder with reference to the accompanying drawings. However, it is to be understood that even when the number, quantity, amount, range or other numerical attribute of an element is mentioned in the following description of the embodiments, the present invention is not limited to the mentioned numerical attribute unless it is expressly stated or theoretically defined. Further, structures or steps or the like described in conjunction with the following embodiments are not necessarily essential to the present invention unless expressly stated or theoretically defined.

First Embodiment

1. Configuration of Cooling Apparatus

An internal combustion engine of the present embodiment is a water-cooled engine (hereunder, referred to as simply "engine") that is cooled by cooling water. The cooling water for cooling the engine is circulated between the engine and a radiator by a cooling water circulation system (cooling water circulation circuit). The cooling water is supplied to both a cylinder block and a cylinder head that constitute the main body of the engine. The configuration of a cooling apparatus of the engine of the present embodiment is described hereunder.

Figure 1:
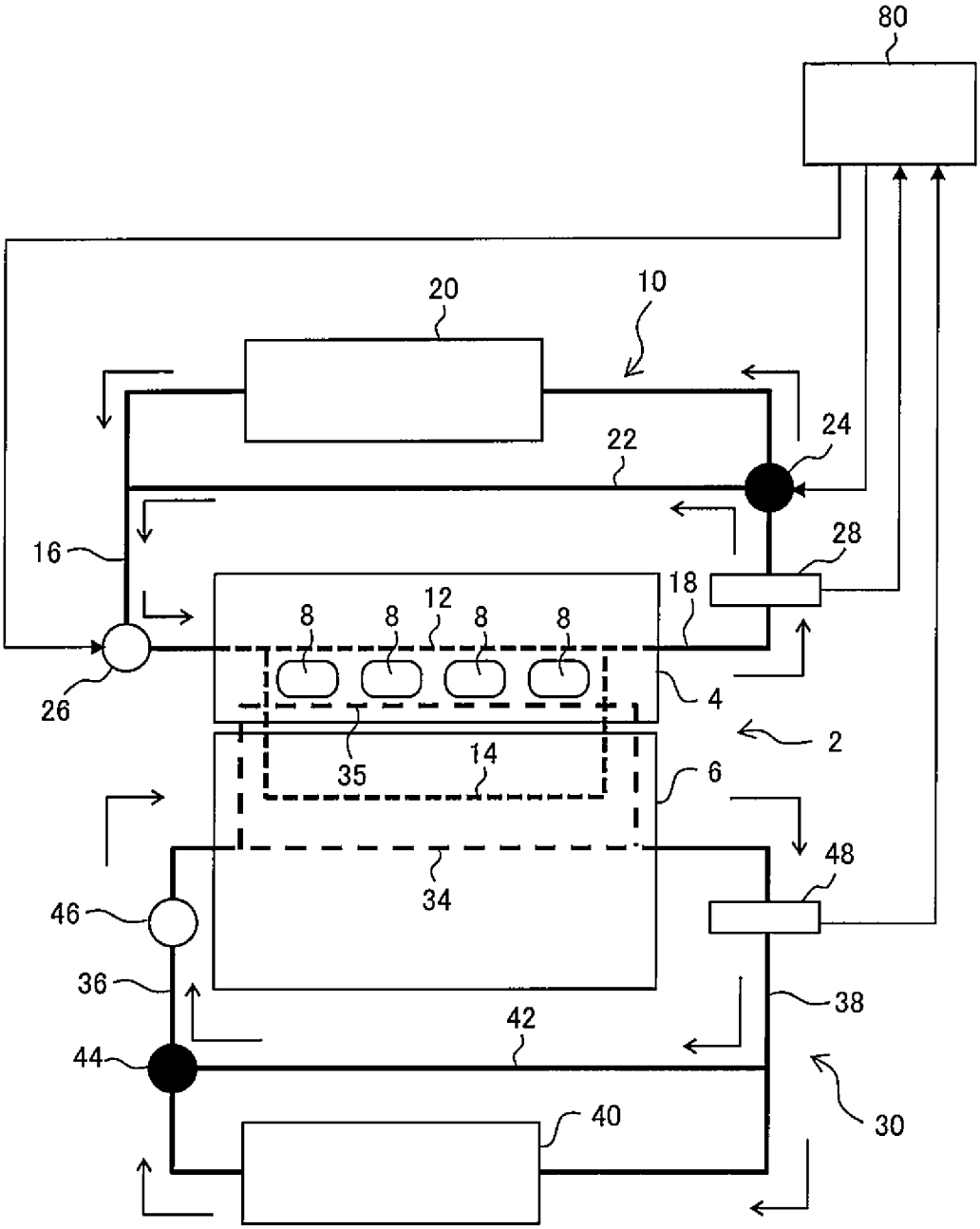
FIG. 1 is a view illustrating a configuration of a cooling apparatus of a first embodiment.

FIG. 1 is a view illustrating the configuration of the cooling apparatus of the present embodiment. The cooling apparatus of the present embodiment includes two cooling water circulation systems 10 and 30 that supply cooling water to an engine 2. Supply of cooling water is performed with respect to both of a cylinder block 6 and a cylinder head 4 of the engine 2. Each of the two cooling water circulation systems 10 and 30 is an independent closed loop, and the temperatures of the cooling water circulated through the respective circulation systems can be made to differ from each other. Hereunder, the cooling water circulation system 10 in which cooling water of a relatively low temperature circulates is referred to as "LT cooling water circulation system", and the cooling water circulation system 30 in which cooling water of a relatively high temperature circulates is referred to as "HT cooling water circulation system". Further, cooling water that circulates through the LT cooling water circulation system 10 is referred to as "LT cooling water", and cooling water that circulates through the HT cooling water circulation system 30 is referred to as "HT cooling water". Note that, "LT" is an abbreviation of "low temperature" and "HT" is an abbreviation of "high temperature".

The LT cooling water circulation system 10 includes an in-head LT cooling water channel 12 that is formed inside the cylinder head 4, and an in-block LT cooling water channel 14 that is formed inside the cylinder block 6. The in-head LT cooling water channel 12 is provided in the vicinity of an intake port 8. In FIG. 1, four intake ports 8 that are the intake ports for four cylinders are shown. The in-head LT cooling water channel 12 extends in the direction of a crankshaft of the engine 2, along the bottom surface of the intake ports 8 of the respective cylinders. The in-block LT cooling water channel 14 is provided so as to surround a portion in which a flow of intake air is particularly liable to collide against an upper portion of the cylinder. The sensitivity of the temperature of the intake port 8 and an intake valve and also a wall surface temperature of the upper portion of the cylinder with respect to knocking is high. Hence, by cooling the aforementioned parts in a concentrated manner by means of the in-head LT cooling water channel 12 and the in-block LT cooling water channel 14, the occurrence of knocking in a high-load region can be effectively suppressed. Note that, the in-head LT cooling water channel 12 and the in-block LT cooling water channel 14 are connected through an opening formed in a mating surface between the cylinder head 4 and the cylinder block 6.

A cooling water inlet and a cooling water outlet that communicate with the in-head LT cooling water channel 12 are formed in the cylinder head 4. The cooling water inlet of the cylinder head 4 is connected to a cooling water outlet of an LT radiator 20 by a cooling water introduction pipe 16, and the cooling water outlet of the cylinder head 4 is connected to a cooling water inlet of the LT radiator 20 by a cooling water discharge pipe 18. The cooling water introduction pipe 16 and the cooling water discharge pipe 18 are connected by a bypass pipe 22 that bypasses the LT radiator 20. A three-way valve 24 is provided at a branching portion at which the bypass pipe 22 branches from the cooling water discharge pipe 18. An electric water pump 26 for circulating LT cooling water is provided downstream of a merging portion with the bypass pipe 22 in the cooling water introduction pipe 16. The discharge rate of the electric water pump 26 can be arbitrarily changed by adjusting the output of a motor. A temperature sensor 28 for measuring the temperature of LT cooling water (cooling water outlet temperature) that passes through the inside of the engine 2 is installed on the upstream side of the three-way valve 24 in the cooling water discharge pipe 18. In the present embodiment, the term "temperature of LT cooling water" refers to a cooling water outlet temperature that is measured by the temperature sensor 28.

The HT cooling water circulation system 30 includes an in-block HT cooling water channel 34 that is formed inside the cylinder block 6, and an in-head HT cooling water channel 35 that is formed inside the cylinder head 4. In contrast to the aforementioned in-block LT cooling water channel 14 that is a locally provided cooling water channel, the in-block HT cooling water channel 34 constitutes a major portion of a water jacket that surrounds the periphery of a cylinder. The in-head HT cooling water channel 35 is provided from the vicinity of an exhaust port to the vicinity of an intake port. Note that, the in-head HT cooling water channel 35 and the in-block HT cooling water channel 34 are connected through an opening formed in the mating surface between the cylinder head 4 and the cylinder block 6.

A cooling water inlet and a cooling water outlet that communicate with the in-block HT cooling water channel 34 are formed in the cylinder block 6. The cooling water inlet of the cylinder block 6 is connected to a cooling water outlet of a HT radiator 40 by a cooling water introduction pipe 36, and the cooling water outlet of the cylinder block 6 is connected to a cooling water inlet of the HT radiator 40 by a cooling water discharge pipe 38. The cooling water introduction pipe 36 and the cooling water discharge pipe 38 are connected by a bypass pipe 42 that bypasses the HT radiator 40. A thermostat 44 is provided at a merging portion at which the bypass pipe 42 merges with the cooling water introduction pipe 36. A mechanical water pump 46 for circulating HT cooling water is provided downstream of the thermostat 44 in the cooling water introduction pipe 36. The water pump 46 is connected through a belt to the crankshaft of the engine 2. A temperature sensor 48 for measuring the temperature of HT cooling water (cooling water outlet temperature) that passes through the inside of the engine 2 is installed upstream of a branching portion with the bypass pipe 42 in the cooling water discharge pipe 38. In the present embodiment, the term "temperature of HT cooling water" refers to a cooling water outlet temperature that is measured by the temperature sensor 48.

As described above, in the HT cooling water circulation system 30, because the water pump 46 is driven by the engine 2, HT cooling water is always circulating while the engine 2 is operating. The temperature of the cooling water circulating through the HT cooling water circulation system 30 is automatically regulated by the thermostat 44. On the other hand, in the LT cooling water circulation system 10, since the electric water pump 26 is used, LT cooling water can be circulated or caused to stop circulating regardless of whether or not the engine 2 is operating. Further, the flow rate of circulating LT cooling water can be controlled by means of a drive duty applied to the electric water pump 26. In addition, the temperature of LT cooling water circulating through the LT cooling water circulation system 10 can be actively adjusted by actuating the three-way valve 24 or the electric water pump 26.

Actuation of the three-way valve 24 and the electric water pump 26 of the LT cooling water circulation system 10 is performed by a control apparatus 80. The control apparatus 80 is a control apparatus of the cooling apparatus and at the same time is also a control apparatus that controls operation of the engine 2. The control apparatus 80 is configured to include as a main constituent an ECU (electronic control unit) that includes one or a plurality of CPUs and memories. The control apparatus 80 adjusts the temperature of the LT cooling water that flows through the in-head LT cooling water channel 12 or the in-block LT cooling water channel 14 to an appropriate temperature by actuating the electric water pump 26 to control the flow rate of the LT cooling water (hereunder, referred to as "LT flow rate"), and by actuating the three-way valve 24 to control the proportion of LT cooling water that bypasses the LT radiator 20.

2. Configuration of Cooling Water Channel formed in Cylinder Head

As shown in FIG. 1, the in-head LT cooling water channel 12 through which LT cooling water that has a low temperature flows and the in-head HT cooling water channel 35 through which HT cooling water that has a high temperature flows are formed in the cylinder head 4. Hereunder, the configurations of these cooling water channels are specifically described referring to a cross-sectional view of the cylinder head 4.

Figure 2:
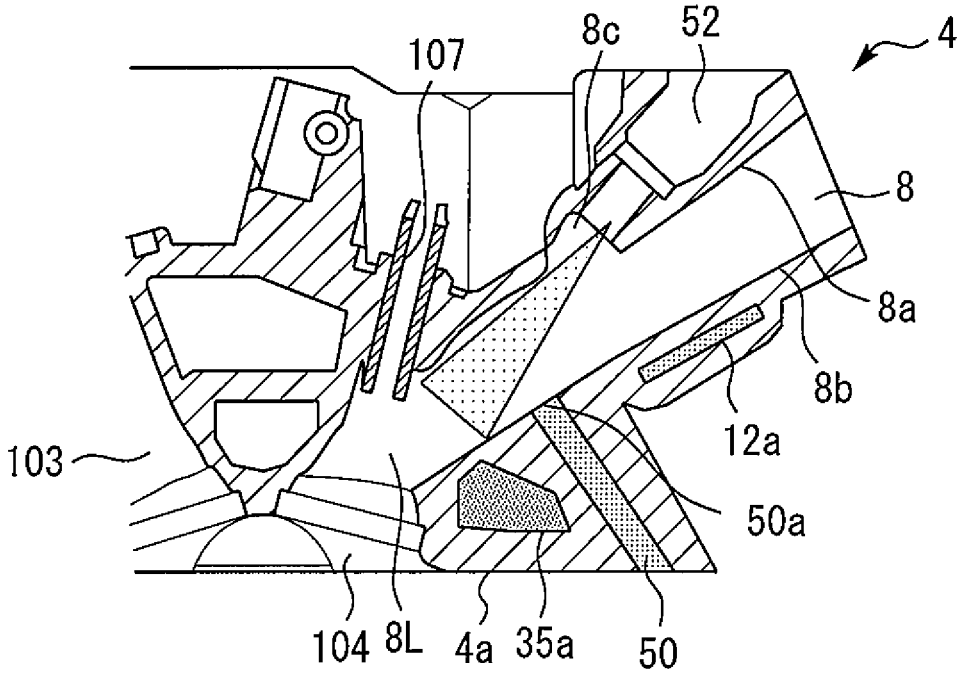
FIG. 2 is a cross-sectional view illustrating a cross section that is perpendicular to a longitudinal direction that includes a central axis of an intake valve insertion hole of a cylinder head.

FIG. 2 is a cross-sectional view illustrating a cross section that is perpendicular to a longitudinal direction (direction of crankshaft) that includes a central axis of an intake valve insertion hole of the cylinder head. However, in FIG. 2, an intake valve and an exhaust valve are illustrated in an abbreviated form. A combustion chamber 104 having a pent-roof shape is formed in a cylinder block mating surface 4*a* that contacts against the underside of the cylinder head 4.

As viewed from the side of the front end of the cylinder head 4, the intake port 8 opens in an inclined face on a right side of the combustion chamber 104. A connecting portion between the intake port 8 and the combustion chamber 104, that is, an opening end on the combustion chamber side of the intake port 8 is an intake opening that is opened and closed by an intake valve which is not illustrated in the drawing. Since two intake valves are provided for each cylinder, two intake openings of the intake port 8 are formed in the combustion chamber 104. The intake port 8 extends in an approximately straight line towards the combustion chamber 104 from an inlet that opens in a side face of the cylinder head 4, and branches into two branch ports along the way, with each of the branch ports connecting to an intake opening formed in the combustion chamber 104. A branch port 8L on the side of the front end of the engine in the longitudinal direction is illustrated in FIG. 2. Note that, the intake port 8 is a tumble flow generating port that can generate a tumble flow in the cylinder.

As viewed from the side of the front end of the cylinder head 4, an exhaust port 103 opens in an inclined face on a left side of the combustion chamber 104. A connecting portion between the exhaust port 103 and the combustion chamber 104, that is, an opening end on the combustion chamber side of the exhaust port 103 is an exhaust opening that is opened and closed by an exhaust valve that is not illustrated in the drawing.

In the cross section shown in FIG. 2, a region denoted by reference character 35*a* is a partial cross section of the in-head HT cooling water channel 35 shown in FIG. 1. Hereunder, the term "in-head HT cooling water channel 35*a*" is used when referring to the region denoted by reference character 35*a*, for example. The in-head HT cooling water channel 35*a* is disposed between a bottom surface 8*b* of the intake port 8 and the cylinder block mating surface 4*a*.

In the cross section shown in FIG. 2, a region denoted by reference character 12*a* is a partial cross section of the in-head LT cooling water channel 12 shown in FIG. 1. The in-head LT cooling water channel 12 extends along the bottom surface 8*b* of the intake port 8 of each cylinder in the longitudinal direction of the cylinder head 4. Hereunder, the term "first water jacket 12*a*" is used when referring to the region denoted by reference character 12*a*, for example. The first water jacket 12*a* is provided so as to cover one part of the bottom surface 8*b* of the intake port 8.

According to the above described configuration that is illustrated in FIG. 2, the intake port 8 can be effectively cooled by the first water jacket 12*a* through which the LT cooling water which has a lower temperature than the HT cooling water flows. By this means, intake air that flows through the intake port 8 can be efficiently cooled.

3. LT Flow Rate Control

Figure 3:
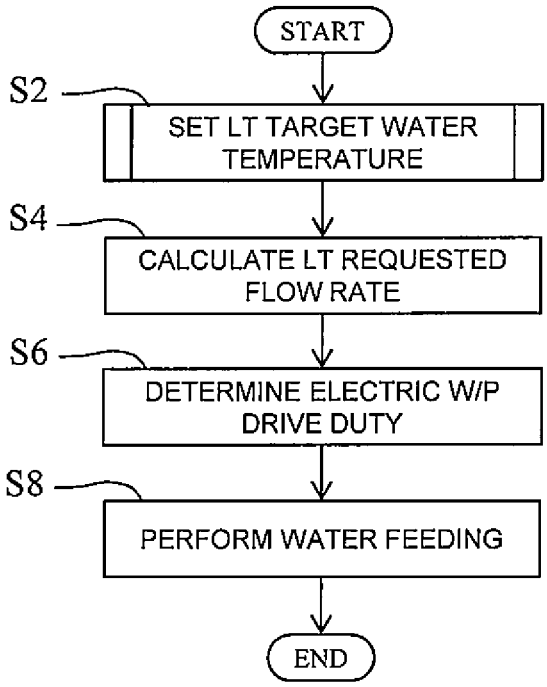
FIG. 3 is a flowchart illustrating a control flow of LT flow rate control.

The control apparatus 80 controls the LT flow rate in order to cool the principal portions of each of the cylinder head 4 and the cylinder block 6 to an appropriate temperature. FIG. 3 is a flowchart illustrating a control flow of LT flow rate control that is performed by the control apparatus 80. The control apparatus 80 repeatedly executes a routine represented by this control flow at predetermined control periods that correspond to the clock speed of the ECU.

First, the control apparatus 80 sets an LT target water temperature that is a target temperature of LT cooling water that flows through the in-head LT cooling water channel 12 or the in-block LT cooling water channel 14 (step S2).

Next, the control apparatus 80 calculates an LT requested flow rate that is a requested value of the LT flow rate based on the LT target water temperature determined in step S2 (step S4). More specifically, the control apparatus 80 refers to a previously prepared map in which the LT target water temperature and the LT requested flow rate are associated, and calculates a feedforward term of the LT requested flow rate, and also calculates a feedback term of the LT requested flow rate based on a difference between the LT target water temperature and a current temperature (outlet temperature) of the LT cooling water that is measured by the temperature sensor 28.

Next, the control apparatus 80 determines a drive duty of the electric water pump 26 based on the LT requested flow rate determined in step S4 (step S6). However, if a valve that adjusts the LT flow rate is provided inside the LT cooling water circulation system 10, the LT flow rate can also be adjusted by actuating the valve to adjust the opening degree thereof.

Finally, the control apparatus 80 actuates the electric water pump 26 in accordance with the drive duty that is determined in step S6 to thereby cause LT cooling water to flow through the in-head LT cooling water channel 12 and the in-block LT cooling water channel 14 (step S8). By this means, the LT flow rate changes and the principal portions of each of the cylinder head 4 and the cylinder block 6 are cooled to an appropriate temperature.

4. Blow-By Gas Recirculation Apparatus

The engine of the present embodiment includes a blow-by gas recirculation apparatus for recirculating blow-by gas that is generated inside the engine main body to an intake passage via a PCV passage. In this case, as described above, the wall surface of the intake port 8 that is covered by the first water jacket 12*a* is cooled by the LT cooling water. Therefore, when blow-by gas is introduced at a position that is on the intake-air upstream side relative to a portion of the wall surface that is covered by the first water jacket 12*a*, the blow-by gas contacts a portion of the wall surface that is covered by the first water jacket 12*a* and is cooled. Because fuel or oil is contained in the blow-by gas, condensed water containing fuel will be generated if the blow-by gas is cooled. If such condensed water circulates to the intake-air downstream side, the condensed water will vaporize upon colliding with an intake valve that is at a high temperature, and as a result deposits will build up.

Therefore, the engine of the present embodiment is configured so that a location at which blow-by gas is recirculated into the intake passage is on the intake-air downstream side relative to the first water jacket 12*a*. More specifically, as shown in FIG. 2, an opening end 50*a* of a PCV passage 50 is connected at the intake-air downstream side relative to the first water jacket 12*a* that covers a portion of the bottom surface 8*b* of the intake port 8. According to this configuration, blow-by gas that passes through the PCV passage 50 and is introduced into the intake port 8 circulates to the intake-air downstream side together with intake air that flows through the inside of the intake port. By this means, because blow-by gas does not contact a portion of the wall surface of the intake port that is covered by the first water jacket 12*a*, it is possible to effectively suppress the occurrence of a situation in which blow-by gas is cooled and condenses.

Note that, as shown in FIG. 2, a port injector insertion hole 52 for mounting a port injector is formed on a top surface 8*a* side of the intake port 8. The port injector insertion hole 52 intersects at an acute angle with the intake port 8, and opens into a port injector mounting portion 8*c* that is formed in an upward convexity on a top surface of a branching portion of the intake port 8. A port injector (not illustrated) that is inserted into the port injector insertion hole 52 projects a nozzle tip out from the port injector mounting portion 8*c* and injects fuel into the intake port 8. Consequently, if fuel injected from the port injector adheres to the wall surface of the intake port 8 at a location on the intake-air upstream side relative to the opening end 50*a* of the PCV passage 50, there is a risk that the fuel will flow to the intake-air downstream side and will block the opening end 50*a*.

Therefore, it is preferable that the opening end 50*a* of the PCV passage 50 is provided so as to be on the intake-air upstream side relative to a spray region of fuel that is injected from the port injector. Note that, the term "spray region" used herein refers to a region in which fuel that is injected from the port injector disperses. By this means it is possible to effectively suppress the occurrence of a blockage of the PCV passage 50 that is caused by fuel injected from the port injector.

In this connection, in the above described embodiment a configuration is adopted in which, in an engine equipped with a blow-by gas recirculation apparatus, the opening end 50*a* of the PCV passage 50 to the intake port 8 is provided at a position on the intake-air downstream side relative to the first water jacket 12*a*. However, an engine to which the present invention can be applied is not limited thereto, and the present invention may also be applied to an engine that is equipped with an EGR apparatus that recirculates a portion of exhaust gas as EGR gas to an intake passage. In this case, it is sufficient to adopt a configuration in which an opening end of the EGR passage for recirculating EGR gas to the intake passage is provided at a position on the intake-air downstream side relative to the first water jacket 12*a*. By this means, cooling by the first water jacket 12*a* of EGR gas that is introduced into the intake port from the EGR passage can be avoided, and hence a buildup of deposits that are caused by condensed water that contains fuel can be effectively suppressed. Note that this similarly applies to a second embodiment that is described later.

Figure 4:
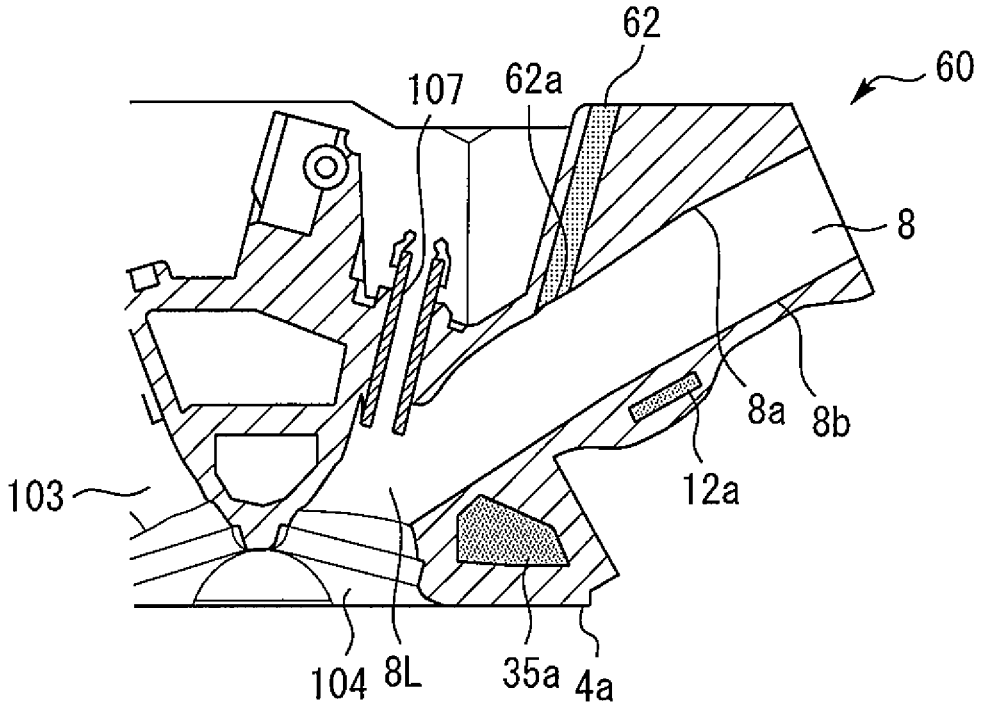
FIG. 4 is a cross-sectional view of a cylinder head for illustrating a modification of the first embodiment.

Further, although in the foregoing embodiment a configuration is described in which the opening end 50*a* of the PCV passage 50 is connected to the bottom surface 8*b* of the intake port 8, a configuration may also be adopted in which the opening end 50*a* of the PCV passage 50 is connected to the top surface 8*a* of the intake port 8. FIG. 4 is a cross-sectional view of a cylinder head for illustrating a modification of the first embodiment. Note that, similarly to FIG. 2, FIG. 4 illustrates a cross section that is perpendicular to a longitudinal direction including a central axis of an intake valve insertion hole 107. Further, elements in FIG. 4 that are common with the configuration shown in FIG. 2 are denoted by the same reference characters, and a description thereof is omitted. In a cylinder head 60 of the modification shown in the present view, an opening end 62*a* of a PCV passage 62 is connected to the top surface 8*a* of the intake port 8. The opening end 62*a* is provided at a position that is on the intake-air downstream side relative to the first water jacket 12*a*. According to this configuration, since cooling of introduced blow-by gas by the first water jacket 12*a* can be avoided, a buildup of deposits caused by condensed water containing fuel can be effectively suppressed.

In the foregoing embodiment, a configuration of the first water jacket 12*a* that covers a portion on the bottom surface 8*b* side of the intake port 8 is described. However, the configuration of the first water jacket 12*a* is not limited thereto, and as long as the first water jacket 12*a* is provided so as to cover a portion of the wall surface that is located on the intake-air upstream side relative to the opening end 50*a*, the first water jacket 12*a* may be configured so as to cover a portion on the top surface 8*a* side of the intake port 8.

Figure 5:
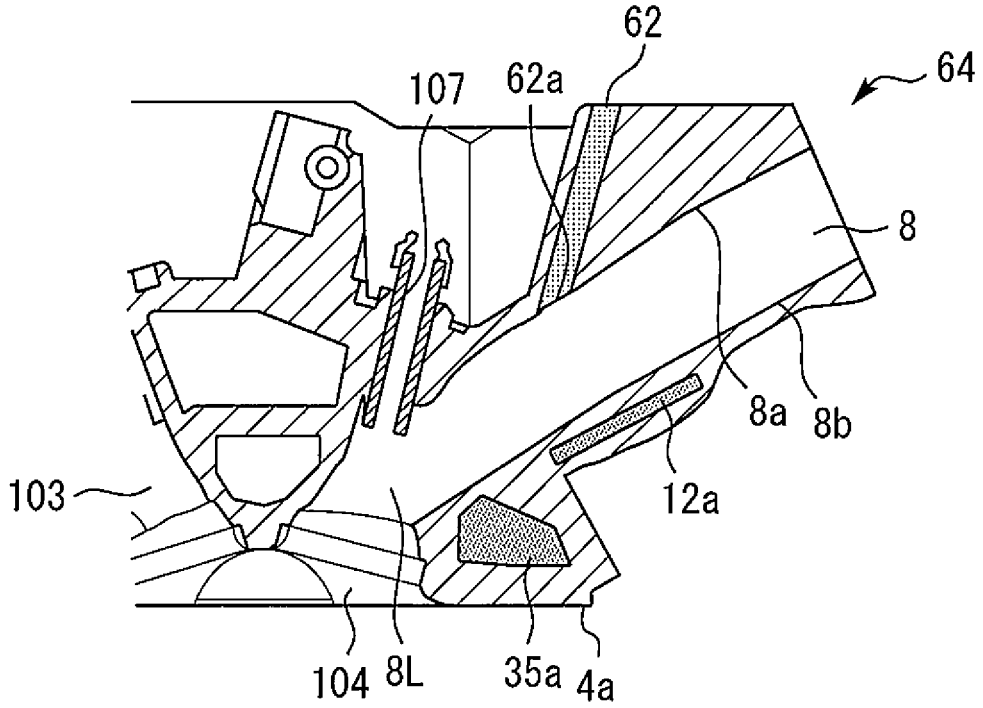
FIG. 5 is a cross-sectional view of a cylinder head for illustrating a modification of the first embodiment.
Figure 6:
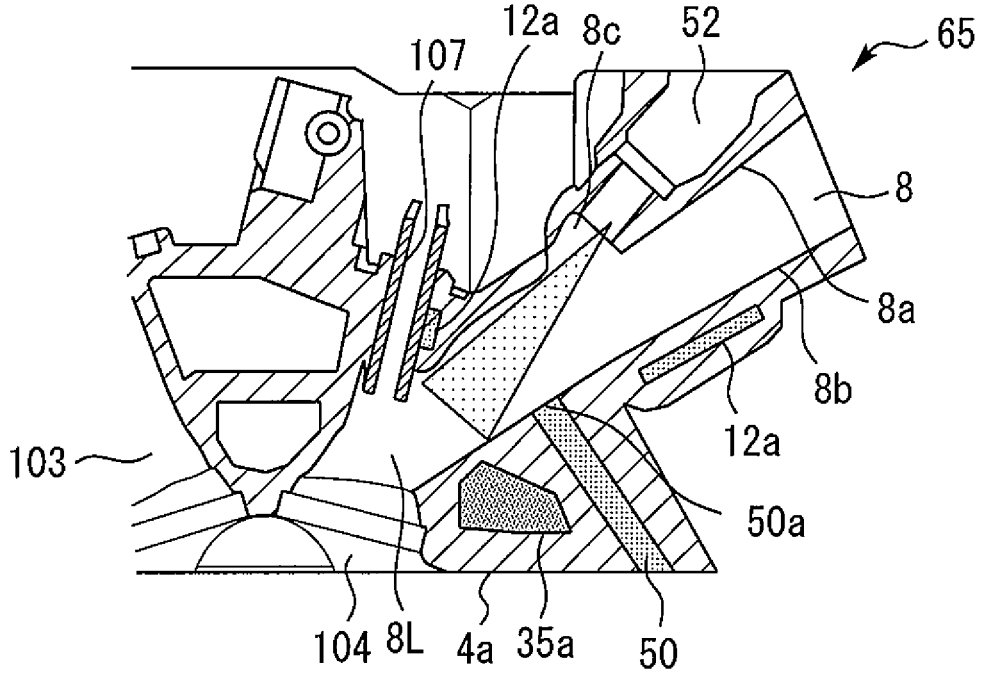
FIG. 6 is a cross-sectional view of a cylinder head for illustrating a modification of the first embodiment.

Further, as long as the first water jacket 12*a* is provided so as to cover a portion of the wall surface that is located on the intake-air upstream side relative to the opening end 50*a*, it is not necessary for all of the first water jacket 12*a* to be located on the intake-air upstream side relative to the opening end 50*a*. FIG. 5 and FIG. 6 are cross-sectional views of cylinder heads for illustrating modifications of the first embodiment. Similarly to FIG. 2, FIG. 5 and FIG. 6 each illustrate a cross section that is perpendicular to a longitudinal direction including a central axis of the intake valve insertion hole 107. As illustrated by the configuration of a cylinder head 64 of the modification shown in FIG. 5, the first water jacket 12*a* may also be provided on the bottom surface 8*b* side of the intake port 8 so as to cover a portion of the wall surface that extends from the intake-air upstream side to the intake-air downstream side of the opening end 50*a*. Further, as illustrated by the configuration of a cylinder head 65 of the modification shown in FIG. 6, the first water jacket 12*a* may also be configured to include a channel that passes through a region between the intake valve insertion hole 107 and the top surface 8*a* of the intake port 8, in addition to a channel that covers one portion of the wall surface that is on the intake-air upstream side of the opening end 50*a*.

In addition, with respect to the portion of the in-head LT cooling water channel 12, preferably a configuration is adopted in which the first water jacket 12*a* covers only one portion of the wall surface on the intake-air upstream side of the opening end 50*a* as shown in FIG. 2, and in which covering of the wall surface on the intake-air downstream side of the opening end 50*a* is avoided. According to this configuration, it is possible to suppress to the maximum the cooling of blow-by gas that is introduced from the opening end 50*a*.

Note that, in the cylinder head of the first embodiment that is described above, the in-head LT cooling water channel 12 corresponds to "low-temperature cooling water channel" of the first aspect of the present invention, the in-head HT cooling water channel 35 corresponds to "high-temperature cooling water channel" of the first aspect of the present invention, the PCV passage 50 or the EGR passage corresponds to "gas channel" of the first aspect of the present invention, the opening end 50*a* or the opening end of the EGR passage corresponds to "opening end" of the first aspect of the present invention, and the first water jacket 12*a* corresponds to "first water jacket" of the first aspect of the present invention.

Second Embodiment

Next, a second embodiment of the present invention will be described using the drawings. The basic configuration of a cylinder head of the second embodiment is the same as that of the cylinder head of the first embodiment except that in the second embodiment a configuration including a straightening vane that is described later and the positional relation between the opening end of the PCV passage and the in-head LT cooling water channel are different from the first embodiment. Therefore, with respect to the other basic configuration of the cylinder head of the second embodiment excluding the aforementioned differences, the description of the basic configuration of the cylinder head of the first embodiment is incorporated as it is into the description of the second embodiment and a duplicate description thereof is not provided here. Hereunder, the characteristic configuration of the cylinder head of the second embodiment is described. The following description is made using cross-sectional views that are perpendicular to a longitudinal direction that includes the central axis of the intake valve insertion hole 107, similarly to FIG. 2. Further, in each of the drawings, elements that are common with elements of the first embodiment are denoted by the same reference characters.

Figure 7:
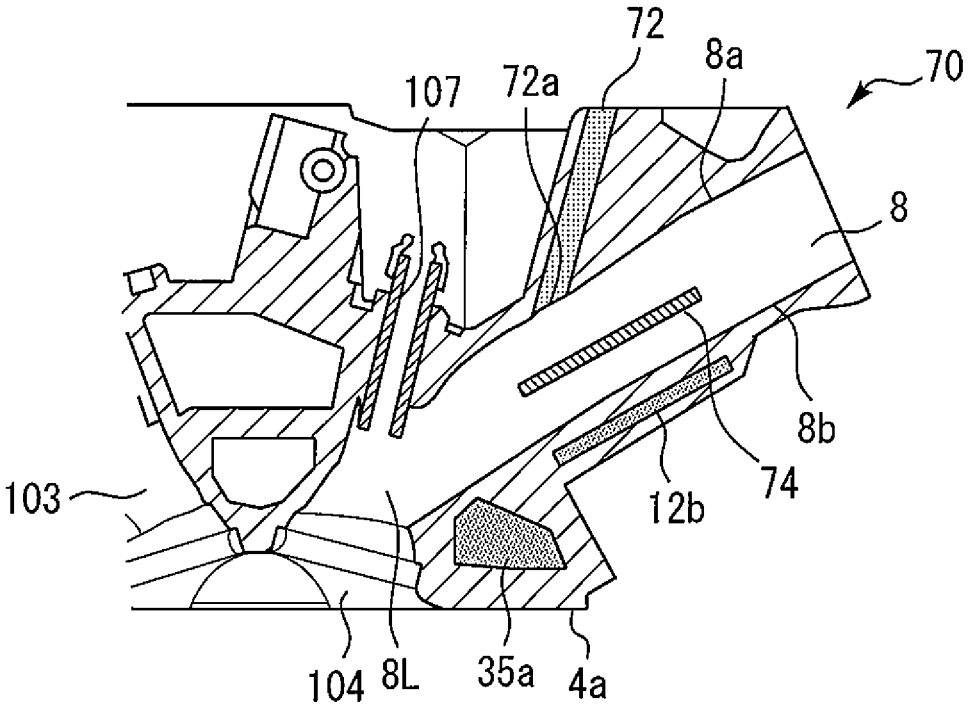
FIG. 7 is a cross-sectional view of a cross section that is perpendicular to a longitudinal direction that includes a central axis of an intake valve insertion hole of a cylinder head of a second embodiment.

FIG. 7 is a cross-sectional view that is perpendicular to a longitudinal direction including a central axis of an intake valve insertion hole of a cylinder head of the second embodiment. In a cylinder head 70 illustrated in FIG. 7, an opening end 72*a* of a PCV passage 72 is connected to the top surface 8*a* of the intake port 8. Further, a second water jacket 12*b* that is a portion of the in-head LT cooling water channel 12 is provided on the bottom surface 8*b* side of the intake port 8 that is a side that faces the opening end 72*a*. The second water jacket 12*b* is configured so that a portion thereof is located further on the downstream side than the opening end 72*a* of the PCV passage 72. In addition, a straightening vane 74 for isolating a space on the top surface 8*a* side and a space on the bottom surface 8*b* side from each other is provided inside the intake port 8. The straightening vane 74 is a flat plate that is disposed along the direction of the flow of intake air, and is set to a length that isolates the aforementioned spaces from each other in a region extending from an intake-air upstream side end of the second water jacket 12*b* to an intake-air downstream side end thereof. Note that, the straightening vane 74 may be fixed inside the intake port 8, or may be rotatably fixed to a shaft that is parallel to the longitudinal direction of the cylinder head that is provided inside the intake port 8 and configured to also have a function that is capable of controlling the strength of a tumble flow by adjustment of a rotational angle thereof.

According to the configuration shown in FIG. 7, blow-by gas that passes through the PCV passage 72 and is introduced from the opening end 72*a* into the intake port 8 circulates to the intake-air downstream side together with intake air that flows through the inside of the intake port. Because the space on the opening end 72*a* side and the space on the second water jacket 12*b* side are isolated from each other by the straightening vane 74, blow-by gas that is introduced into the intake port 8 from the opening end 72*a* is prevented from contacting a portion of the wall surface that is covered by the second water jacket 12*b*. By this means, the occurrence of a situation in which blow-by gas is cooled and condenses can be effectively suppressed.

In this connection, although in the above described second embodiment the straightening vane 74 is set to a length that isolates the aforementioned spaces in a region from an intake-air upstream side end of the second water jacket 12*b* to an intake-air downstream side end thereof, the configuration of the straightening vane 74 is not limited thereto. That is, the shape and arrangement and the like thereof are not particularly limited as long as the configuration prevents blow-by gas that passes through the PCV passage 72 and is introduced from the opening end 72*a* into the intake port 8 from contacting a portion of the wall surface that is covered by the second water jacket 12*b*.

Figure 8:
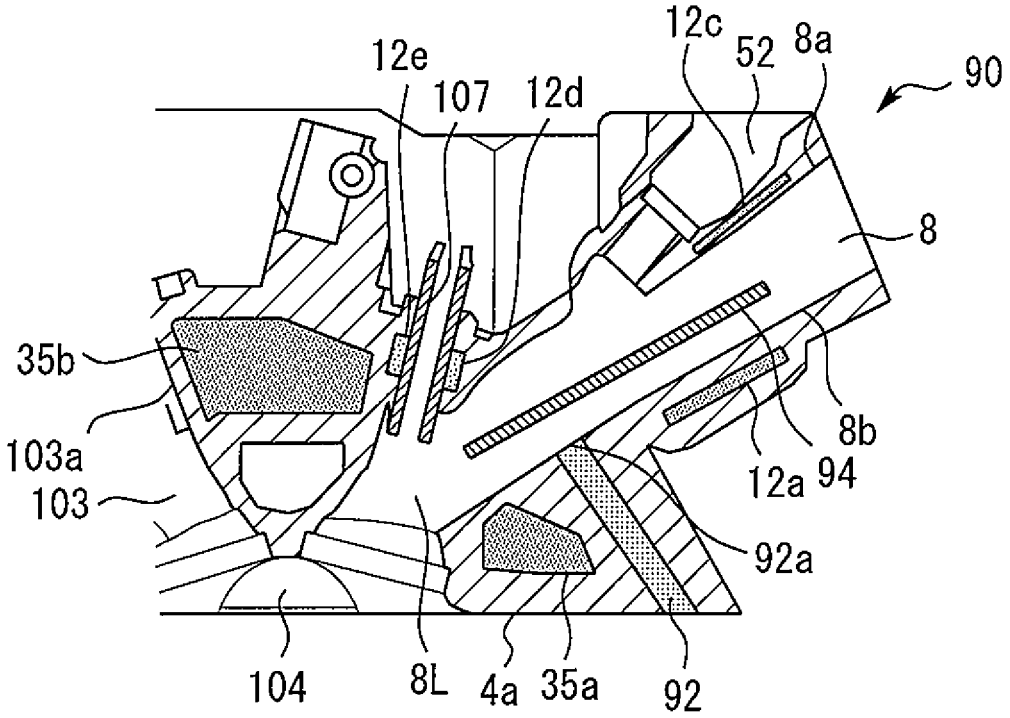
FIG. 8 is a cross-sectional view of a cylinder head for illustrating a modification of the second embodiment.

Further, although in the foregoing second embodiment a configuration is described in which the opening end 72*a* of the PCV passage 72 is connected to the top surface 8*a* of the intake port 8, a configuration may also be adopted in which the opening end 72*a* of the PCV passage 72 is connected to the bottom surface 8*b* of the intake port 8. FIG. 8 is a cross-sectional view of a cylinder head for illustrating a modification of the second embodiment. Note that FIG. 8 illustrates a cross section that is perpendicular to a longitudinal direction that includes the central axis of the intake valve insertion hole 107, similarly to FIG. 7. Further, elements in FIG. 8 that are common with elements in FIG. 7 are denoted by the same reference characters, and a description of such elements is omitted hereunder.

In a cylinder head 90 of the modification illustrated in FIG. 8, an opening end 92*a* of a PCV passage 92 is connected to the bottom surface 8*b* of the intake port 8. Further, in the cross section illustrated in FIG. 8, a portion 35*b* of the in-head HT cooling water channel is arranged in a region that is near to a top portion of the pent roof of the combustion chamber 104 and that is a region that lies between a top surface 103*a* in the vicinity of the exhaust opening of the exhaust port 103 and the top surface 8*a* in the vicinity of the intake opening of the intake port 8. Note that, although the in-head HT cooling water channels 35*a* and 35*b* are separated in the cross section illustrated in FIG. 8, the in-head HT cooling water channels 35*a* and 35*b* are connected to form a single channel at a plurality of places in the longitudinal direction inside the cylinder head 4.

In the cross section illustrated in FIG. 8, first water jackets 12*a* and 12*c* are provided on the intake-air upstream side of the opening end 92*a*. The first water jacket 12*a* is provided on the bottom surface 8*b* side of the intake port 8. The first water jacket 12*c* is provided on the top surface 8*a* side of the intake port 8. Further, in the cross section shown in FIG. 8, second water jackets 12*d* and 12*e* are provided on the intake-air downstream side of the opening end 92*a*. The second water jacket 12*d* is a channel that passes through a region between the intake valve insertion hole 107 and the top surface 8*a* of the intake port 8. The second water jacket 12*e* is a channel that passes through a region that is nearer to the center of the cylinder head 4 than the intake valve insertion hole 107. Note that, although the first water jackets 12*a* and 12*c* and the second water jackets 12*d* and 12*e* of the in-head LT cooling water channel 12 are separated in the cross section illustrated in FIG. 8, these water jackets 12*a* and 12*c* and water jackets 12*d* and 12*e* are connected to form a single water jacket at a plurality of places in the longitudinal direction inside the cylinder head 4.

In addition, in the cross section illustrated in FIG. 8, a straightening vane 94 for isolating a space on the top surface 8*a* side and a space on the bottom surface 8*b* side from each other is provided inside the intake port 8. The straightening vane 94 is set to a length that isolates the aforementioned spaces from each other in a region from an intake-air upstream side end of the intake port 8 at which the first water jacket 12*a* is arranged to an intake-air downstream side end of the intake port 8 at which the second water jackets 12*d* and 12*e* are arranged. Note that, similarly to the straightening vane 74 shown in FIG. 7, the shape and arrangement and the like of the straightening vane 94 are not particularly limited as long as the configuration prevents blow-by gas that passes through the PCV passage 92 and is introduced from the opening end 92*a* into the intake port 8 from contacting a portion of the wall surface that is covered by the second water jackets 12*d* and 12*e*.

According to the configuration illustrated in FIG. 8, blow-by gas that passes through the PCV passage 92 and is introduced from the opening end 92*a* into the intake port 8 circulates to the intake-air downstream side together with intake air that flows through the inside of the intake port. Because the space on the side of the opening end 92*a* and the space on the side of the second water jackets 12*d* and 12*e* are isolated from each other by the straightening vane 94, blow-by gas that is introduced from the opening end 92*a* into the intake port 8 is prevented from contacting a portion of the wall surface that is covered by the second water jackets 12*d* and 12*e*. By this means, even in a case where the in-head LT cooling water channel 12 is provided on both the intake-air upstream side and the intake-air downstream side of the opening end 92*a*, it is possible to effectively suppress the occurrence of a situation in which blow-by gas that is introduced into the intake port 8 is cooled and condenses.

Note that, in the cylinder head of the second embodiment that is described above, the in-head LT cooling water channel 12 corresponds to "low-temperature cooling water channel" of the first aspect of the present invention, the in-head HT cooling water channel 35 corresponds to "high-temperature cooling water channel" of the first aspect of the present invention, the PCV passage 50 or EGR passage corresponds to "gas channel" of the first aspect of the present invention, the opening end 50*a* or opening end of the EGR passage corresponds to "opening end" of the first aspect of the present invention, and the first water jacket 12*a* corresponds to "first water jacket" of the first aspect of the present invention.

Further, in the cylinder head of the second embodiment that is described above, the second water jackets 12*b*, 12*d* and 12*e* correspond to "second water jacket" in the fourth aspect of the present invention, and the straightening vanes 74 and 94 correspond to "straightening vane" of the fourth aspect of the present invention.

Further, in the cylinder head of the second embodiment that is described above, the in-head LT cooling water channel 12 corresponds to "low-temperature cooling water channel" of the sixth aspect of the present invention, the in-head HT cooling water channel 35 corresponds to "high-temperature cooling water channel" of the sixth aspect of the present invention, the PCV passage 50 or EGR passage corresponds to "gas channel" of the sixth aspect of the present invention, the opening end 50*a* or opening end of the EGR passage corresponds to "opening end" of the sixth aspect of the present invention, and the first water jacket 12*a* corresponds to "water jacket" of the sixth aspect of the present invention.

The invention claimed is:

1. A cylinder head for an internal combustion engine including two cooling water circulation systems in which temperatures of cooling water are different, comprising:

an intake port;

a low-temperature cooling water channel for circulating cooling water of a low temperature, a high-temperature cooling water channel for circulating cooling water of a higher temperature than cooling water flowing through the low-temperature cooling water channel;

a gas channel for recirculating a portion of blow-by gas or EGR gas to the intake port;

an opening end opening at a wall surface of the intake port from the gas channel; and a port injector provided in the intake port, wherein the low-temperature cooling water channel is configured to include a first water jacket covering at least one portion of the wall surface of the intake port, the at least one portion being located on an intake-air upstream side relative to the opening end, wherein the opening end is provided on an intake-air upstream side relative to a spray region of fuel from the port injector.

2. A cylinder head for an internal combustion engine including two cooling water circulation systems in which temperatures of cooling water are different, comprising:

an intake port;

a low-temperature cooling water channel for circulating cooling water of a low temperature;

a high-temperature cooling water channel for circulating cooling water of a higher temperature than cooling water flowing through the low-temperature cooling water channel;

a gas channel for recirculating a portion of blow-by gas or EGR gas to the intake port; and an opening end opening at a wall surface of the intake port from the gas channel;

wherein the low-temperature cooling water channel is configured to include a first water jacket covering at least one portion of the wall surface of the intake port, the at least one portion being located on an intake-air upstream side relative to the opening end, wherein the low-temperature cooling water channel is configured to include a second water jacket covering at least one portion of the wall surface of the intake port, the at least one portion being located on an intake-air downstream side relative to the opening end; and a straightening vane is provided inside the intake port to prevent gas introduced from the opening end into the intake port from contacting the wall surface covered by the second water jacket.

3. The cylinder head according to claim 2, wherein:

the second water jacket is configured so as to cover a wall surface on a side facing the opening end; and the straightening vane is provided from the opening end to the wall surface covered by the second water jacket, so as to separate the intake port into a side of the wall surface covered by the second water jacket and a side of the opening end.

* * * * *